US006092316A

United States Patent [19]

Brinker

[11] Patent Number: 6,092,316

[45] Date of Patent: Jul. 25, 2000

[54] EJECTOR APPARATUS FOR AN EARTH MOVING SCRAPER BOWL

[75] Inventor: Lee J. Brinker, Glen Elder, Kans.

[73] Assignee: Kan-Am Industries, Inc., Beloit, Kans.

[21] Appl. No.: 09/095,298

[22] Filed: Jun. 10, 1998

Related U.S. Application Data

[63] Continuation of application No. 08/789,337, Jan. 27, 1997, Pat. No. 5,839,212.

[51] Int. Cl.[7] ..... E02F 3/64

[52] U.S. Cl. ..... 37/416; 37/419; 37/426

[58] Field of Search ..... 37/416, 901, 414, 37/412, 411, 418, 419, 421, 426, 427, 431, 903; 172/799.5, 781, 297, 298, 675

[56] References Cited

U.S. PATENT DOCUMENTS

| | | | |
|---|---|---|---|
| 2,271,790 | 2/1942 | Allin | 37/416 |
| 2,303,650 | 12/1942 | Low | 37/426 |
| 3,100,945 | 8/1963 | Bernotas | 37/416 |
| 3,122,248 | 2/1964 | Campbell et al. . | |
| 3,431,663 | 3/1969 | Eiger . | |
| 3,462,859 | 8/1969 | Hawk . | |
| 3,474,548 | 10/1969 | Miller | 37/426 |
| 3,484,690 | 12/1969 | Kokaly et al. | 37/416 |
| 3,872,612 | 3/1975 | Gee . | |
| 3,947,981 | 4/1976 | Shore | 37/416 |
| 4,255,885 | 3/1981 | Mitchell et al. . | |
| 4,308,677 | 1/1982 | Behm . | |
| 4,366,635 | 1/1983 | Joyce, Jr. . | |
| 5,603,382 | 2/1997 | McIver . | |

FOREIGN PATENT DOCUMENTS

| | | | |
|---|---|---|---|
| 67219 | 7/1948 | Denmark | 37/901 |
| 2448002 | 8/1930 | France | 37/901 |
| 1086078 | 4/1984 | U.S.S.R. | 37/901 |
| 2064473 | 6/1981 | United Kingdom | 37/901 |

*Primary Examiner*—Victor Batson
*Attorney, Agent, or Firm*—Shughart, Thomson & Kilroy

[57] ABSTRACT

An earth mover includes a scraper bowl with an arcuate bottom wall and a pair of side walls attached to a frame. An ejector panel is supported by a pair of pivoting support links, each of which is pivotally attached to the frame above the upper limit of the bowl side walls and each of which is also pivotally attached to the ejector panel. The ejector panel is selectively movable through a shallow arc which mirrors the shape of the of the bowl bottom wall while the pair of support links support the ejector panel in a substantially upright position as it moves from a forward, ejecting position to a retracted position in which the ejector panel forms a rearward wall for the scraper bowl.

17 Claims, 4 Drawing Sheets

EJECTOR APPARATUS FOR AN EARTH MOVING SCRAPER BOWL

CROSS REFERENCE TO RELATED APPLICATIONS

This application is a continuation of application Ser. No. 08/789,337, entitled EJECTOR APPARATUS FOR AN EARTH MOVING SCRAPER BOWL, filed Jan. 27, 1997, now U.S. Pat. No. 5,839,212.

BACKGROUND OF THE INVENTION

This invention relates to earth moving scrapers of the load ejector type and more particularly to an ejector apparatus which provides efficient and complete ejection of the load in the scraper bowl.

Earth moving scrapers generally comprise a bucket or bowl having upstanding parallel side walls rigidly secured to a bottom wall which forms an open front end through which soil passes to load the bowl. The bottom wall is provided with a forwardly extending blade which cuts and loosens soil when the bowl is in a lower generally horizontal earth contacting position. An ejector panel is supported between the bowl walls and extends from one wall to the other adjacent the plane of the bottom wall to permit the ejector panel to be moved from a rearward soil loading position to a forward load ejecting position as the scraper is moved forwardly.

The scraper is towed by a prime mover and is wheel supported at its rearward end. Hydraulic actuators permit the bowl to be raised to an upward position for transporting soil and then lowered to its horizontal position for loading the bowl. It has been the practice to support the ejector panel on the bowl bottom by rollers and move it forward and rearwardly by hydraulic actuators. This type of ejector panel mounting has not always proved satisfactory for the reason one side or the other of the ejector panel may be moved forwardly out of synchronization with the opposite or other side and thus bind the ejector panel between the bowl walls. This invention provides ejector panel supporting links mounted on respective side walls of the bowl rearwardly of the ejector panel and swingably mounting the ejector panel there between.

SUMMARY OF THE INVENTION

An earth moving scraper having a bowl frame is supported at its forward end by a prime mover hitch and is supported at its rearward end by wheels on a wheel frame pivotally connected with the rearward limit of the bowl frame on a horizontal axis. The bowl comprises a bottom wall having rigidly interconnected side walls defining an open front and an open rearward end. The bowl bottom wall is provided with a cutting blade for cutting earth when the bowl is lowered to a generally horizontal position adjacent the surface of the earth. The bowl rearward opening is normally closed by an ejector panel extending transversely between the side walls and pivotally connected with the side walls by pairs of links permitting horizontal swinging movement of the ejector panel in which the lower limit of the ejector panel describes an arc of a circle during its forward and rearward movement. The bottom wall of the bowl being similarly arcuately bowed downwardly between its forward and rearward limits on a radius slightly greater than the radius of the arc described by the lower limit of the ejector panel.

In its swinging movement during earth ejecting movement an apron extending transversely between the side walls at their forward end portions coacts with the blade at the forward end of the bowl bottom wall to form a transverse aperture limiting the amount of soil discharged from the bowl in the load ejecting movement of the ejector panel.

The principal object of this invention is to provide a scraper in which the ejector panel is prevented from binding contact with the bowl side walls or its bottom.

DESCRIPTION OF PREFERRED EMBODIMENTS

Figure 1:
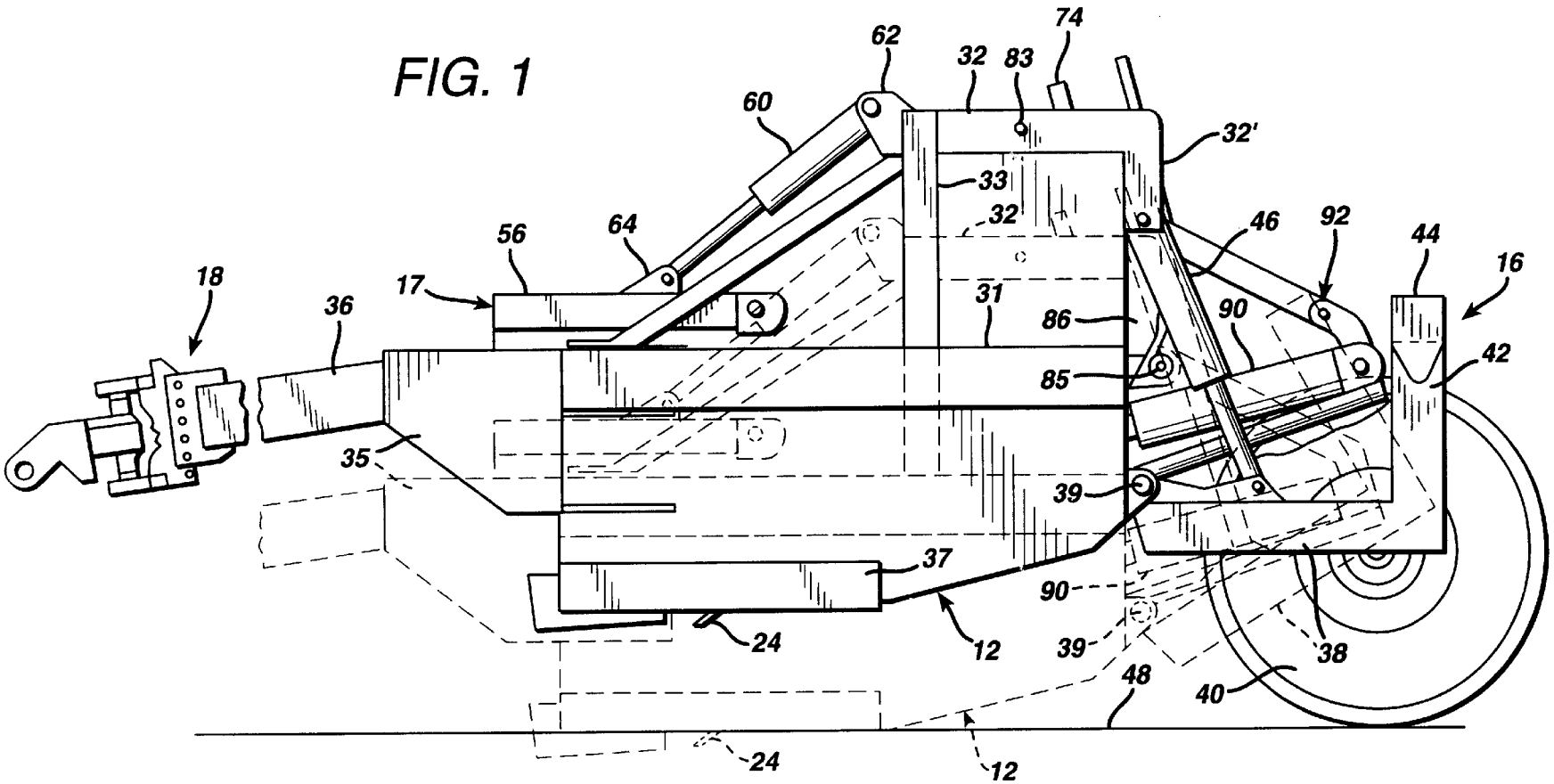
FIG. 1 is a side elevational view illustrating by dash lines the bowl loading position.

Like characters of reference designate like parts in those figures of the drawings in which they occur.

In the drawings:

The reference numeral 10 indicates an earth moving scraper formed by a rigid frame and bowl structure 12 having a load ejection 14 within the bowl; a wheel and frame 16 for supporting the rearward end of the bowl structure; a pivoting apron 17 for opening and closing the forward end of the bowl; and, a hitch 18 for connection with a prime mover such as a tractor (not shown) for moving the earth scraper 10. The earth scraper 10 further includes a plurality of conduits and hoses connected with a suitable fluid power supply (not shown) on the tractor for operating pressure actuators such as hydraulic cylinders, as will presently be explained.

The bowl and frame structure 12 comprises a bottom wall 20 secured at its rearward limit to a frame beam 22 extending transversely coextensive with the rearward limit of the bottom wall 20 soil cutting blade 24 secured to its forward limit in forwardly projecting down turned relation. The bottom wall 20 forward end portion is substantially horizontal and the remaining rearwardly extending portion is inclined upwardly and is arcuately bowed downwardly on a selected radius between its forward and rearward limits to form an arcuate concave surface 26.

Upstanding side walls 28 and 30 are rigidly secured to opposite sides of the bowl bottom 20. Horizontal and vertical side beams 31, 32 and 33 are secured to the outer surfaces of the walls 28 and 30. A forward transverse frame beam 34 and forward side plates 35 secured to the forward end portions of the side walls 28 and 30 prevent spreading of the walls during soil loading action as presently explained. A tongue 36 connects the hitch member 18 with the forward frame members 34 and 35.

The wheel frame 16 comprises a plurality of normally horizontal axle support bars 38 pivotally connected at their forward end portions to a transverse shaft 39 supported by plates secured to the bowl bottom wall cross beam support 22 and journal, at their rearward end portions, the axles of a plurality of wheels 40 (only one being shown). The frame 16 further includes a plurality of standards 42 rigidly secured at their depending ends to the rearward end portion of the axle support bars 38 in orthogonal relation. The upper end portion of the standards 42, projecting above the plurality of wheels 40, are interconnected by a coextensive box beam 44. A pair of actuators 46 are connected at one end with a depending leg 32' of the side wall top cross beams 32 and an intermediate portion of the outermost axle support bar 38 for pivoting the wheel frame 16 relative to the bowl structure 12 to lower the latter to the surface of the earth 48 in a soil cutting and pick-up action as presently explained and as illustrated by dash lines (FIG. 1).

The front apron 17 cooperates with the bowl structure 12 in retaining a load of earth therein and comprises an arcuate center plate 50 having a rearward depending edge 52, which abuts the cutter blade 24 when in load retaining position, terminating at its upper limit substantially in the plane of the upper limit of the side beams 31. A pair of apron side plates 54 are secured to respective sides of the apron 50 inwardly of the bowl side walls 28 and 30. A pair of apron lift arms 56 are secured to the upper limit of the respective apron side plate 54 and are pivotally connected with the bowl side plates 28 and 30 by pins 58 for vertical pivoting movement of the apron 17 in opening and closing the forward end of the bowl 12. This is accomplished by a pair of apron actuators 60 interposed between lugs 62 on the bowl top side beams 32 and a pair of lugs 64 secured to the respective apron lift arm 56.

Figure 2:
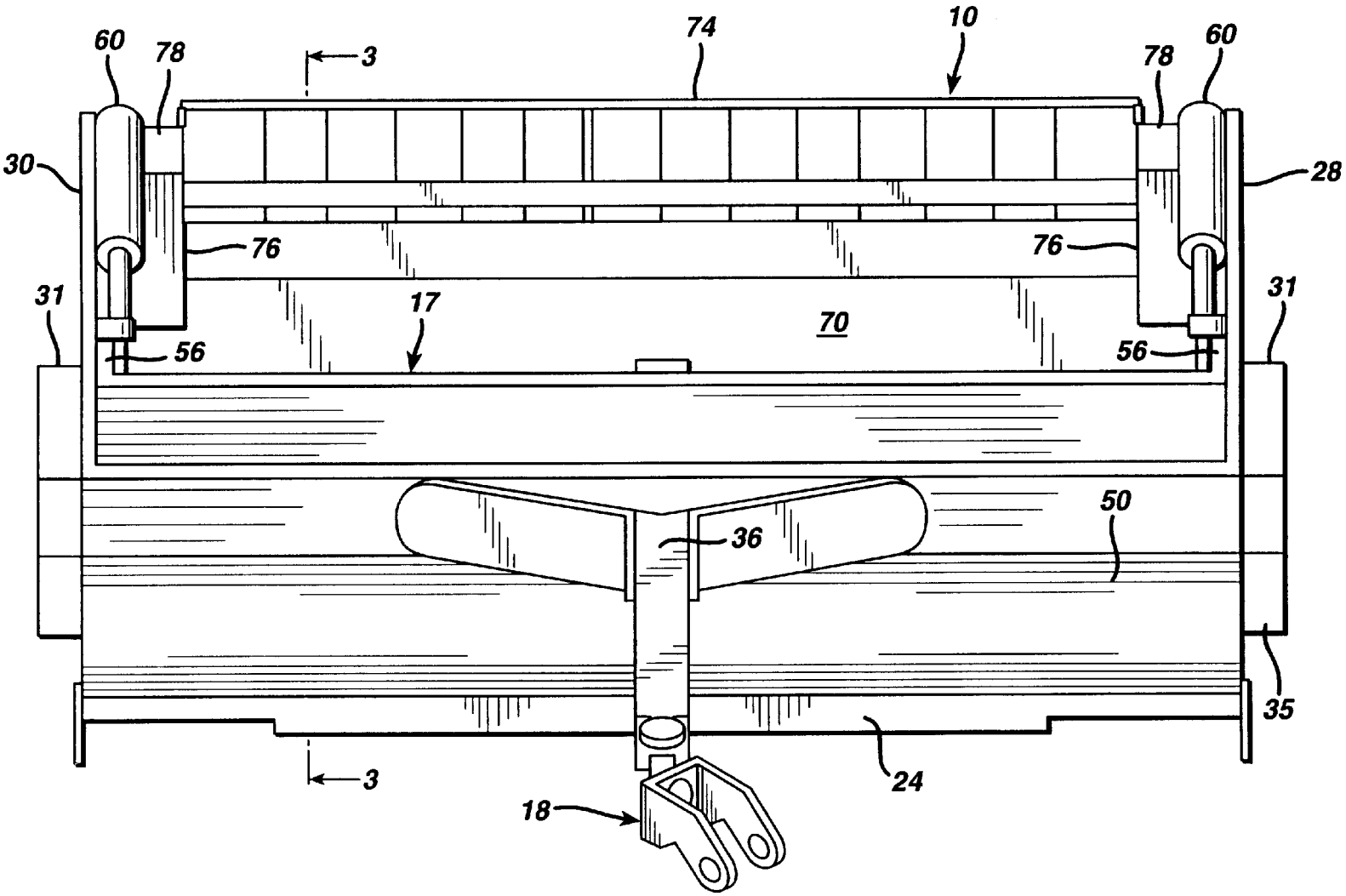
FIG. 2 is a front elevational view.
Figure 3:
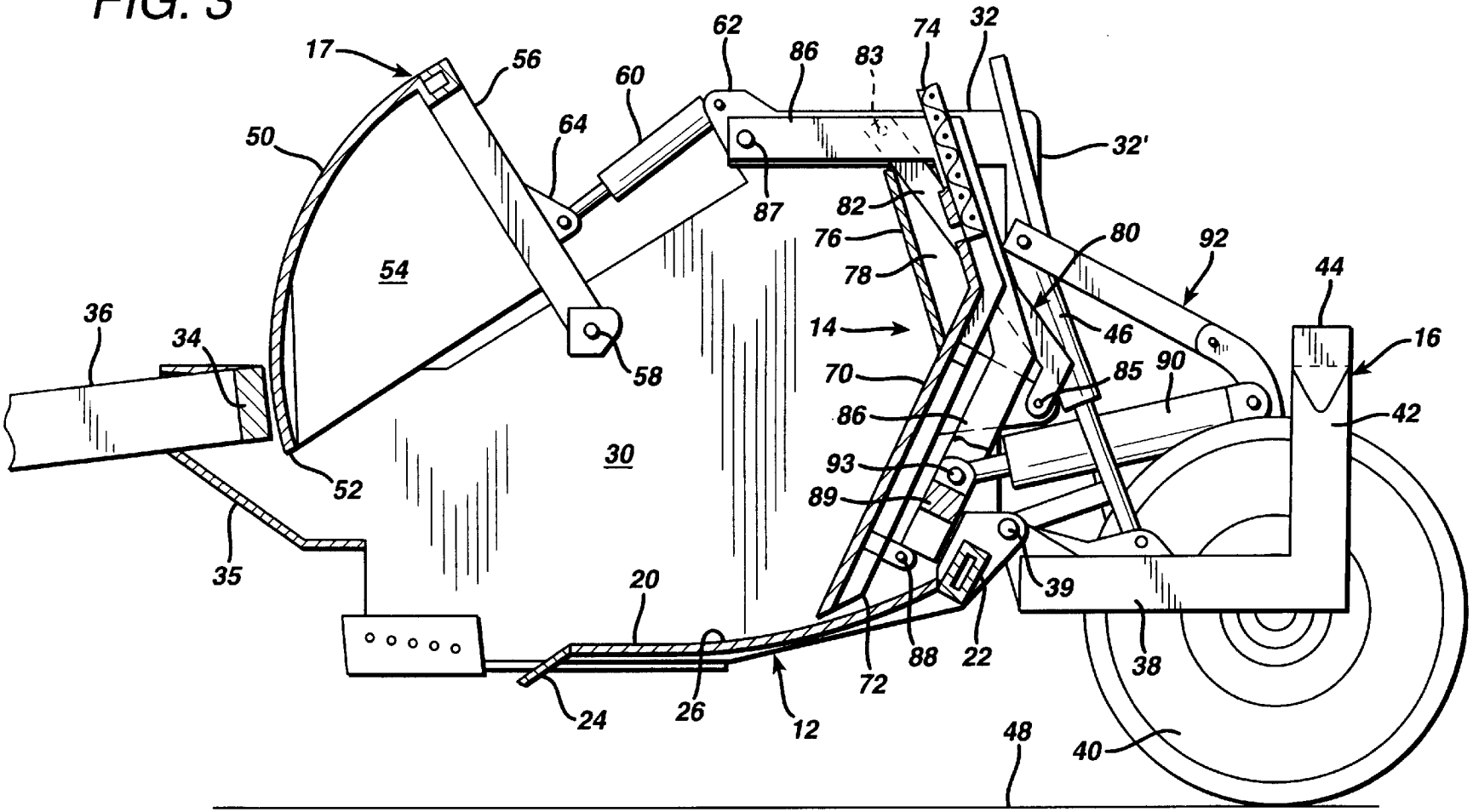
FIG. 3 is a vertical cross-section view to a larger scale partly in elevation illustrating the ejector panel in retracted position taken substantially along the line 3—3 of FIG. 2; and, FIG. 4 is a view similar to FIG. 3 illustrating the ejector panel in its forward position.

The ejector 14 comprises a first or lower ejector panel 70 extending between the bowl side walls 28 and 30 normally closing the rearward opening of the bowl when in a retracted position. The panel 70 has a forward planar face and its rearward or opposite surface is reinforced by box tubing 72. A screen or second panel 74 is inclined forwardly and extends upwardly from the upper limit of the bottom panel 70 to prevent soil being pushed over the rearward upper limit of the panel 70 during bowl loading operation. The screen panel 74 terminates at its respective sides, inwardly of the respective sides of the bottom panel 70 (FIG. 2). An L-shaped wall 76 at each end of the screen panel is secured thereto and to the upper limit of the bottom panel 70 to form an upwardly and laterally open recess 78 at each end of the screen panel above the lower panel 70 for nesting the upper end portion of pairs of ejector panel supporting link 80, at each side of the panel 70, when the ejector 14 is in the retracted position (FIG. 3). The two pairs of link 80 are identical with each other and only one pair is described in the interest of brevity. The link 80 comprises a first substantially "L" shaped support link 82 pivotally connected at its upper end by a pin 83 substantially medially the length of the bowl top side beam 32 and pivotally connected to a rearwardly projecting lug 84 on the adjacent upper side limit of the panel 70 by a pin 85 for vertical pivoting movement of the lower end portion of the link 82 about the axis of the pin 83. A second ejector support and push off link 86, substantially "C" shaped in side elevation, is pivotally connected at its upward end portion by a pin 87 to the side wall lug 62 and pivotally connected at its depending end to the adjacent side edge of the rearward lower limit of the ejector panel 70 by a pin 88. A link push off actuator 90 is pivotally connected at one end to an actuator support frame 92, projecting rearwardly and upwardly from the rearward end of the bowl 12 medially its width and between a pair of the wheels 40 and extends forwardly and is connected by its rod portion to a cross brace 89 extending between the depending end portions of the second links 86 by a pin 93.

OPERATION

Figure 4:
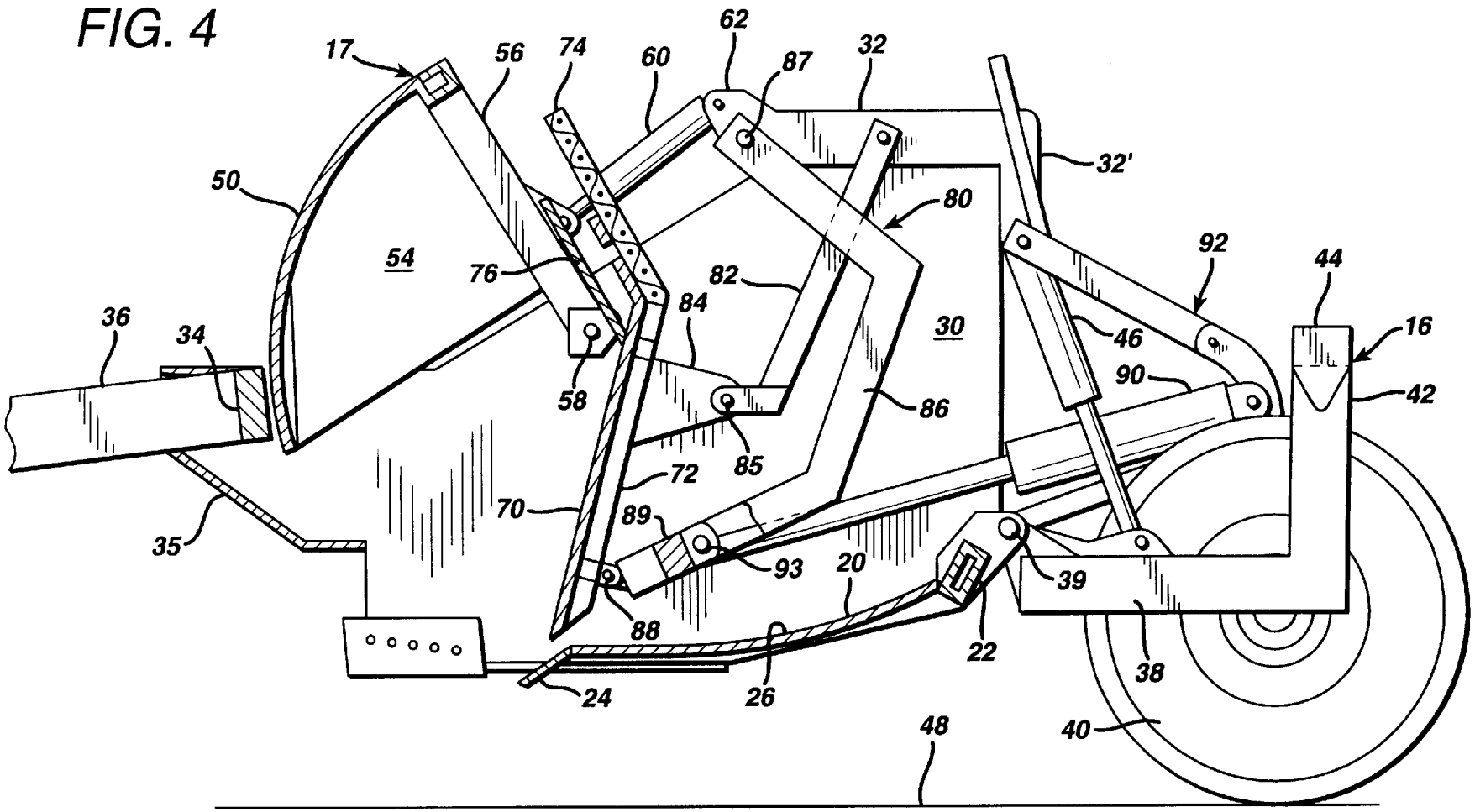

In operation the bowl 12 is filled with soil in a manner substantially conventional with earth scrapers of this type and briefly stated comprises moving the apparatus 10 in a forward direction with the apron 17 raised to its upward position as illustrated by FIG. 4 while simultaneously lowering the bowl for the blade 24 to engage the surface of the earth 48 by operating the wheel frame pivoting actuators 46 to pivot the wheel frame 16 about the axis of the shaft 39 disposing the bowl structure 12 and the wheel frame 16 in the dashed line position of FIG. 1. When the bowl is loaded with a desired quantity of earth (not shown) the apparatus 10 is moved to a place for dumping or unloading the earth. With the apron 17 in the lifted position or, with its rearward edge 52 disposed in selected spaced relation with respect to the cutting blade 24 for controlling the quantity of earth being moved through the open end of the bowl, the ejector 14 is moved forwardly by the push off actuator 90 extending its piston rod. The depending edge of the panel 70 moves in a path adjacent and complemental with the concave upper surface 26 of the bowl bottom 20, thus moving bowl contained earth out the forward end of the bowl until the ejector and link 80 reach the position illustrated by FIG. 4. After discharging the load the actuator 90 is operated to return the links and ejector panels to the retracted position (FIG. 3) completing one cycle of operation.

The invention is susceptible to changes or alterations without defeating its practicability. Therefore, I do not wish to be confined to the preferred embodiments shown in the drawings and described herein.

What is claimed and desired to be secured by Letters Patent is as follows:

1. An earth mover comprising:

(a) a bowl structure including an arcuate bottom wall with forward and rearward limits and a pair of side walls;

(b) a frame attached to and extending upward from said bowl structure;

(c) a wheel frame, said wheel frame being attached to and being selectively pivotable relative to said frame and bowl structure such that the frame and bowl structure can be moved between a lowered, soil cutting and pick-up position and a raised, soil transport position;

(d) a generally upright ejector panel having front and rear surfaces and a depending marginal edge, said ejector panel extending transversely between said side walls;

(e) a first pair of ejector panel support links, each having a first end pivotably attached to said frame above said bowl structure and a second end pivotably attached to said ejector panel rear surface, said support link supporting said ejector panel in a position such that said depending marginal edge is adjacent the bowl structure arcuate bottom wall;

(f) a second pair of elector panel support links, each with a first end pivotally attached to said frame above said bowl structure and a second end pivotally attached to the rear surface of said ejector panel, a combination of said first and second elector panel support link pairs supporting said elector panel in a substantially upright position as said ejector panel marginal edge swings through said arc; and (g) a link push-off actuator comprising a hydraulic piston and cylinder unit pivotally attached at a first end to said wheel frame and pivotally attached at a second end to one of said second pair of ejector panel support links, said actuator being selectively movable between an extended position in which said ejector panel marginal edge is swung through an arc, with said support link providing a pivot point for the arc, to a position proximate the forward limit of said bottom wall and a retracted position in which said ejector panel is swung, again via said arc, to a position proximate the rearward limit of said bowl structure bottom wall.

2. An earth mover as in claim 1, and further comprising a screen attached to and extending upward from said ejector panel with said screen also extending transversely between said side walls.

3. An earth mover as in claim 1, and further comprising a center plate, said center plate being selectively pivotable between an open position which allows soil to be loaded or off-loaded from said bowl structure and a closed position which retains soil in said bowl structure.

4. An earth mover as in claim 1, and further comprising a wheel frame pivoting actuator with a first end attached to said wheel frame and a second end attached to said frame whereby extension of said pivoting actuator pivots said wheel frame downward relative to said bowl structure and frame and retraction of said pivoting actuator pivots said wheel frame upward relative to said bowl structure and frame.

5. An earth mover comprising:

(a) a bowl structure including a bottom wall with forward and rearward limits, said bottom wall forming a shallow arc between said forward and rearward limits, and a pair of side walls;

(b) a frame attached to and extending upward from said bowl structure;

(c) a wheel frame, said wheel frame being attached to and being selectively pivotable relative to said frame and bowl structure such that the frame and bowl structure can be moved between a lowered, soil cutting and pick-up position and a raised, soil transport position;

(d) a generally upright ejector panel having front and rear surfaces and a depending marginal edge, said ejector panel extending transversely between said side walls;

(e) a first pair of ejector panel support links, each having a first end pivotally attached to said frame above said bowl structure and a second end pivotally attached to said ejector panel;

(f) a second pair of ejector panel support links, each with a first end pivotally attached to said frame above said bowl structure and a second end pivotally attached to the rear surface of said ejector panel, the combination of said first and second ejector panel support links supporting said ejector panel in a substantially upright position as said ejector panel marginal edge swings through a second arc which mirrors the arc formed by said bowl structure bottom wall; and (g) a link push-off actuator comprising a hydraulic piston and cylinder unit pivotally attached at a first end to said wheel frame and pivotally attached at a second end to one of said second pair of ejector panel support links, said actuator being selectively movable between an extended position and a retracted position between which said ejector panel marginal edge is swung through said second arc between a position proximate the forward limit of said bottom wall and a position proximate the rearward limit of said bottom wall, respectively.

6. An earth mover as in claim 5, wherein said first ejector panel support link has a substantially L shape with a long leg of the L including said first link first end which is pivotally attached to said frame and a short leg of the L being including said first link second end pivotally attached to the rear surface of said ejector panel.

7. An earth mover as in claim 6, wherein said second ejector panel support link is substantially C shaped with an upper leg of the C including said second link first end pivotally attached to said frame, a lower leg of said C including said second link second end pivotally attached to said ejector panel rear surface and a middle leg connecting said upper and lower legs to form said C.

8. An earth mover as in claim 7, wherein an attachment point between said frame and said first support link is positioned behind an attachment point between said frame and said second support link.

9. An earth mover as in claim 7, wherein an attachment point between said ejector panel and said first support link is positioned above an attachment point between said ejector panel and said second support link.

10. An earth mover as in claim 5, and further comprising a screen attached to and extending upward from said ejector panel with said screen also extending transversely between said side walls.

11. An earth mover as in claim 5, and further comprising a center plate, said center plate being selectively pivotable between an open position which allows soil to be loaded or off-loaded from said bowl structure and a closed position which retains the soil in said bowl structure.

12. An earth mover as in claim 5, and further comprising a wheel frame pivoting actuator with a first end attached to said wheel frame and a second end attached to said bowl structure and frame whereby extension of said pivoting actuator pivots said wheel frame downward relative to said bowl structure and frame and retraction of said pivoting actuator pivots said wheel frame upward relative to said bowl structure and frame.

13. An earth mover comprising:

(a) a bowl structure including a bottom wall with forward and rearward limits, said bottom wall forming a shallow arc between said forward and rearward limits, and a pair of side walls;

(b) a frame attached to and extending upward from said bowl structure;

(c) a wheel frame, said wheel frame being attached to and being selectively pivotable relative to said frame and bowl structure such that the frame and bowl structure can be moved between a lowered, soil cutting and pick-up position and a raised, soil transport position;

(d) a generally upright ejector panel having front and rear surfaces and a depending marginal edge, said ejector panel extending transversely between said side walls;

(e) a first pair of generally L shaped ejector panel support links, each having a long leg of the L including a first link first end which is pivotally attached to said frame and a short leg of the L including a first link second end pivotally attached to the rear surface of said ejector panel;

(f) a second pair of generally "C" shaped ejector panel support links, each with an upper leg of the C including a second link first end pivotally attached to said frame, a lower leg of said C including a second link second end pivotally attached to said ejector panel rear surface and a middle leg connecting said upper and lower legs to form said C, the combination of said first and second pairs of ejector panel support links supporting said ejector panel in a substantially upright position as said ejector panel marginal edge swings through a second arc which mirrors the arc formed by said bowl structure bottom wall; and (g) a link push-off actuator operatively connected to said ejector panel rear surface, said link push-off actuator being selectively movable between an extended position and a retracted position between which said ejector panel marginal edge is swung through said second arc between a position proximate the forward limit of said bottom wall and a position proximate the rearward limit of said bottom wall, respectively.

14. An earth mover as in claim 13, wherein said link push-off actuator comprises a hydraulic piston and cylinder unit pivotally attached at a first end to said wheel frame and pivotally attached at a second end to said ejector panel rear surface.

15. An earth mover as in claim 13, wherein:

(a) attachment points between said frame and said first pair of support links are positioned behind attachment points between said frame and said second pair of support links; and (b) attachment points between said ejector panel and said first pair of support links are positioned above attachment points between said ejector panel and said second pair of support links.

16. An earth mover as in claim 13, and further comprising a screen attached to and extending upward from said ejector panel with said screen also extending transversely between said side walls.

17. An earth mover as in claim 13, and further comprising a center plate, said center plate being selectively pivotable between an open position which allows soil to be loaded or off-loaded from said bowl structure and a closed position which retains soil in said bowl structure.

* * * * *